US006418565B1

(12) United States Patent
Tsujino

(10) Patent No.: US 6,418,565 B1
(45) Date of Patent: Jul. 16, 2002

(54) WRESTLING EAR GUARD

(75) Inventor: Kanzo Tsujino, Orange, CA (US)

(73) Assignee: ASKS Corporation, Kobe (JP)

( * ) Notice: Subject to any disclaimer, the term of this patent is extended or adjusted under 35 U.S.C. 154(b) by 0 days.

(21) Appl. No.: 09/938,429

(22) Filed: Aug. 23, 2001

Related U.S. Application Data

(60) Provisional application No. 60/259,543, filed on Jan. 4, 2001.

(51) Int. Cl.[7] ..... A63B 71/10
(52) U.S. Cl. ..... 2/425; 2/209
(58) Field of Search ..... 2/209, 423, 425, 2/455, 411–414; 128/864, 866

(56) References Cited

U.S. PATENT DOCUMENTS 2,277,994 A * 3/1942 Roberts ..... 2/425
2,413,283 A * 12/1946 Berg ..... 2/209
2,886,818 A * 5/1959 Roberts ..... 2/425
2,898,596 A * 8/1959 Keen ..... 2/425
3,327,316 A * 6/1967 Pukish ..... 2/425
3,513,482 A * 5/1970 Holden ..... 2/425
4,821,345 A * 4/1989 Marchello ..... 2/425
5,685,021 A * 11/1997 Tsujino ..... 2/425

* cited by examiner

*Primary Examiner*—Gloria M. Hale
*Assistant Examiner*—Tejash Patel
(74) *Attorney, Agent, or Firm*—Michael E. Zall

(57) ABSTRACT

A protective headgear is provided that includes a pair of ear guards, each having generally crescent-shaped or kidney-shaped core. Preferably, a pattern of vent openings is provided in the core to connect the interior and exterior surfaces. A one-piece removable ear guard covering of a flexible material covers each ear guard. The covering has a core portion with vents that communicate with the vents on the core to allow a wearer to hear. The covering also includes a peripheral edge portion that extends between the core portion and a peripheral edge and covers the exterior surface of the core. The covering also includes an interior peripheral edge portion for extending about a portion of the interior surface of the core. A layer of cushioning material, preferably gel cushioning material, may be positioned along the interior surface of the peripheral edge of the cover. A plurality of elongate apertures are positioned on the core, and a corresponding plurality of slots are positioned on the cover for interconnecting ear guards with a plurality of adjustable head straps.

24 Claims, 9 Drawing Sheets

WRESTLING EAR GUARD

RELATED APPLICATIONS

This application claims the benefit of Provisional Application No. 60/259,543 filed on Jan. 4, 2001, the entire disclosure of which is incorporated herein by reference.

BACKGROUND OF THE INVENTION

1. Field of the Invention

This invention relates to wrestling ear guards, i.e., protective headgear used by wrestlers and the like, adopted to protect against injuries to the ears.

2. Prior Art

Protective head gear, i.e., wrestling helmets and wrestling ear guards, of the type to which this invention pertains are well known in the art. Most athletic sanctioning bodies require the use of such headgear in order to compete. Typically such headgear includes a pair of ear covering, cup-like guards secured to the wearer's head by means of straps that extend over the top of the head, around the rear of the head, and under the chin. The guards, which cover and protect the wearer's ears, contain a pad which is necessary for the wearer's comfort and protection. The ear pads are shaped in a generally triangular form to provide an ear receiving pocket which extends around the outside of the ear and against the wearer's head.

Examples of this type of headgear are described in the following references:

U.S. Pat. Nos. 2,277,994 and 2,886,818 to Roberts describes an ear guard for athletic headgear that includes a cup having a marginal flange and a U-shaped rubber member enclosing the marginal flange attached by rivets. The two ear guards are held in place by a suitable number of properly arranged head and chin bands which are attached to each other and the marginal flange by rivets. The headgear includes bands that are adjustable.

U.S. Pat. No. 2,898,596 to Keen describes ear protecting headgear having a pair of ear guards each having a substantially rigid inner shell and peripheral flanges. Each ear guard is covered by a shock absorbing material covering the entire outer surface and inner surfaces of the flanges. A plurality of adjustable non-elastic head straps connect the ear guards.

U.S. Pat. No. 3,311,921 to Helm describes wrestling headgear, similar to the aforementioned Roberts references, but having additional ventilation covered by a protective gridwork to prevent the insertion of a finger therethrough.

U.S. Pat. No. 3,327,316 to Pukish, Jr. describes a padded ear piece for use in wrestling headgear that prevents the rapid change of air pressure adjacent the wearer's ear opening. The head straps are formed of elastic material and are affixed to the padded ear pieces. One of the chin straps is connected to the ear piece by means of a releasable coupler such as a snap fastener, buckle or VELCRO hook and loop fastener.

U.S. Pat. No. 3,513,482 to Holden describes various wrestling headgear that include an ear covering having a peripheral flange comprised of a rubbery material. The inner shells of the ear guards are of rigid construction, typically of molded plastic, aluminum, spun glass or polyethylene. Additionally, a plurality of VELCRO hook and loop straps and a snap fasten chin strap are used to retain the headgear on the wrestler.

U.S. Pat. No. 3,541,611 to Beguin describes hearing protector ear cups supported by a lightweight head harness formed of flexible, substantially non-elastic straps. Attachment of the hearing protection cups to the head harness is effected by looping depending straps through a slotted rigid ear cup mounting ring within which the ear cup is pivotally mounted.

U.S. Pat. No. 3,594,815 to Reese describes a wrestler's helmet made from a continuous piece of knitted fabric which is elastic in mutual perpendicular directions.

U.S. Pat. No. 3,778,844 to Hori, et al. describes a configuration around the ears of a motorcycle helmet to prevent whistling.

U.S. Pat. No. 4,023,213 to Rovani describes a shock absorbing system for a football helmet comprising a web of a plurality of air filled compartments.

U.S. Pat. No. 4,287,613 to Schulze describes a helmet having an energy absorbing and sizing means mounted on the inside surface of the shell.

U.S. Pat. No. 4,516,274 to Buckland describes an adjustable ear cup retention harness adapted for use within rigid helmet shells. The helmet includes downwardly extending, inwardly concave sides which extend over and cover the ears of the wearer. The ear cups are provided with yieldable pads around the periphery of the parts of the ear cup intended to touch the wearer's head.

U.S. Pat. No. 4,551,861 to Marchello describes an ear pad for fastening within the ear protective guard of a helmet. The ear pad is formed of a thick, resilient, rubber-like sheet material that is molded with a central ear receiving pocket surrounded by bulged, cushion-forming strips which engage the wearer's head around the ear.

U.S. Pat. No. 4,612,672 to Shrack describes a protective headgear designed for use in water sports. The headgear has a ring-shaped member adapted to surround a wearer's head in combination with a cross-member extending from opposite edges of the ring shaped member. A pair of ear flaps extend downwardly from opposite edges of the ring shaped member. The device also has a sun visor and an adjustable chin strap.

U.S. Pat. No. 4,710,985 to Dubner, et al. describes a protective headgear designed to protect the ears of wrestlers. The headgear includes a pair of ear guards having a shock absorbing inner foam surface with a substantially triangular ridge adapted to engage the head surrounding the ear. An outer vinyl covers the ear guard and an intermediate foam is bonded to the outer vinyl and inner foam surface. Top and rear head straps are included to attach the gear to the wearer's head by VELCRO hook and loop means and a chin strap is used to connect the lower portions of the guard to engage the wearer's chin.

U.S. Pat. No. 4,853,980 to Zarotti describes a padding element for a crash helment.

U.S. Pat. No. 4,862,563 to Flynn describes a flexible securing strap having VELCRO hook and loop material at the ends.

U.S. Pat. No. 5,288,143 to Marchello describes an ear guard assembly with a removable pad.

U.S. Pat. No. 5,361,420 to Dobbs, et al, describes a protective headgear for wrestler formed of nylon netting material that covers substantially the entire scalp.

Applicant is aware of the Brute MAXX ear guard that is a one-piece fabric ear guard have a front, rear strap and chin strap having VELCRO hook and loop closures.

All of the above protective headgear suffer from certain problems. Foremost among these problems is that the headgear may be uncomfortable and/or not provide insufficient coverage for the ears of the wrestler. Another serious shortcoming of most of the prior art devices is that a particular design is adaptable be worn by many individuals, each having a different size and shape head. In use, the wrestling ear guard is subjected to various pulls, tugs, pushes and shears. It thus becomes very difficult to have a single design of an ear guard that can remain substantially immobile on the wrestlers head during competition. Some previous efforts attempted to correct this problem through the use of a multiplicity of head straps. This, however, creates the additional problem of providing adjustable straps which are not easy to use and render the already uncomfortable headgear even more so.

Cushioning elements filled with a gel cushioning material are well known in the art for use in shoes. For example, U.S. Pat. No. 4,768,295 to Ito describes a gel cushioning member for a shoe formed so as to have a plurality of chambers. When the cushioning member is placed in the recess formed in the sole plate, the filled chambers contact the bottom thereof and air chambers are formed between the filled chambers and the bottom of the recess. The air in the air chambers is compressed as the sole plate and the cushioning members are deformed by shock upon landing. See also U.S. Design Pat. Nos. 300,084 and 300,085 to Ito, et al. and U.S. Design Pat. No. 297,381 to Sugiyama. Other gel containing cushions for use in shoes are described in U.S. Pat. Nos. 5,115,927 and 5,493,792 to Bates, et al. Shoes containing such gel filled cushioning elements are sold, for example, by ASICS Tiger Corporation, Fountain Valley, Calif. Such cushioning elements have not been used in headgear, particularly wrestling headgear. U.S. Pat. No. 5,685,021 to Tsujino describes wrestling ear guards, wherein each ear guard has a generally disk-like core having a peripheral edge portion and a layer of gel cushioning material, preferably silicon gel cushioning material covers the interior surface of the peripheral edge.

OBJECTS AND SUMMARY OF THE INVENTION

It is an object of this invention to provide a novel headgear for wrestlers and the like that will protect their ears from injuries.

It is another object of this invention to provide wrestling ear guards having crescent shaped shells that protect the ears.

It is an additional object of this invention to provide headgear for wrestlers, the headgear having a crescent shape for providing a snug and comfortable fit about a wearer's ears.

It is a further object of this invention to provide headgear for wrestlers, the headgear having a crescent shape and an angled profile for fitting in close contact along a user's ears to minimize interference with a user's peripheral vision.

It is yet an additional object of this invention to provide headgear for wrestlers, the headgear having a crescent shape and a plurality of vents for allowing a user to hear through the headgear.

It is yet another object of this invention to provide headgear for wrestlers that has a cushioning element surrounding the ears to provide enhanced protection for the ears.

It is a further object of this invention to provide protective headgear which is relatively comfortable to wear during the athletic activity.

It is another object of this invention to provide protective headgear that is securely affixed to the wearer's head with a minimum of straps that are easily adjustable, but which do not provide an irritant and/or will not come out of adjustment during the athletic activity.

It is a further object of the present invention to provide protective headgear that is easily manufactured and competitively priced.

Still another object of this invention is to improve the gripping surface of the ear pad surrounding the ear during violent wrestling activities.

These and other objects and advantages are achieved by the improved protective headgear of this invention. The headgear includes a pair of ear guards. Each ear guard has a generally crescent core having a crescent-shaped forward edge, a peripheral edge portion, an interior surface and an exterior surface. Preferably, a pattern of vent openings is provided in the core that connect the interior and exterior surfaces. A one-piece removable ear guard covering of a flexible material covers each ear guard. The covering preferably has a core portion with vent openings proximate to the vent openings in the core. The covering also includes a peripheral edge portion that covers the exterior surface of the peripheral edge, and extends about a portion of the interior surface along the peripheral edge. A layer of gel cushioning material, preferably silicon gel cushioning material, may be interconnected with an interior portion of the covering.

The headgear additionally has a plurality of apertures positioned about the peripheral edge portion of each ear guard and a plurality of head straps. The covering includes a plurality of slots proximate the plurality of apertures. Each head strap extends through a slot and has one end secured to an aperture on one ear guard, and the other end extending through a corresponding slot and adjustably secured to a corresponding aperture on the other ear guard by releasably engagable hook and pile retainers on the head strap. Some of the straps may have both ends adjustably secured to corresponding apertures by such hook and pile type fasteners.

With the above and other objects in view, the nature of the invention will be more clearly understood by reference to the following detailed description, the appended claimed subject matter, and the several views illustrated in the accompanying drawings.

DETAILED DESCRIPTION OF THE INVENTION

Figure 1:
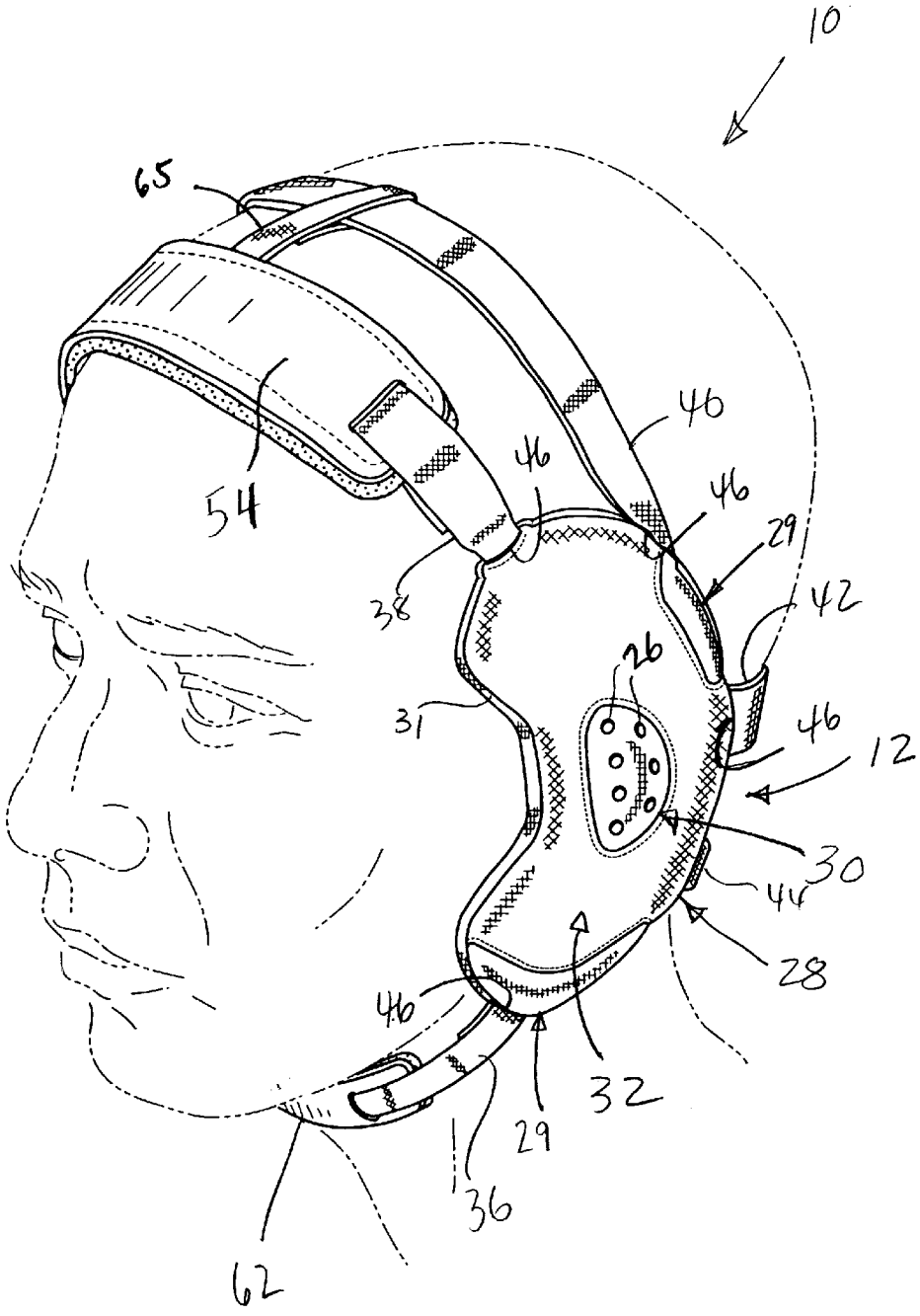
FIG. 1 is a perspective view of the wrestling headgear of this invention positioned on a wearer's head.

A novel protective wrestling headgear constructed in accordance with this invention is fully illustrated in FIGS. 1–9 and is generally designated by the reference numeral 10. The headgear 10 includes a pair of ear guards 12, 14 which are of identical construction.

Figure 4:
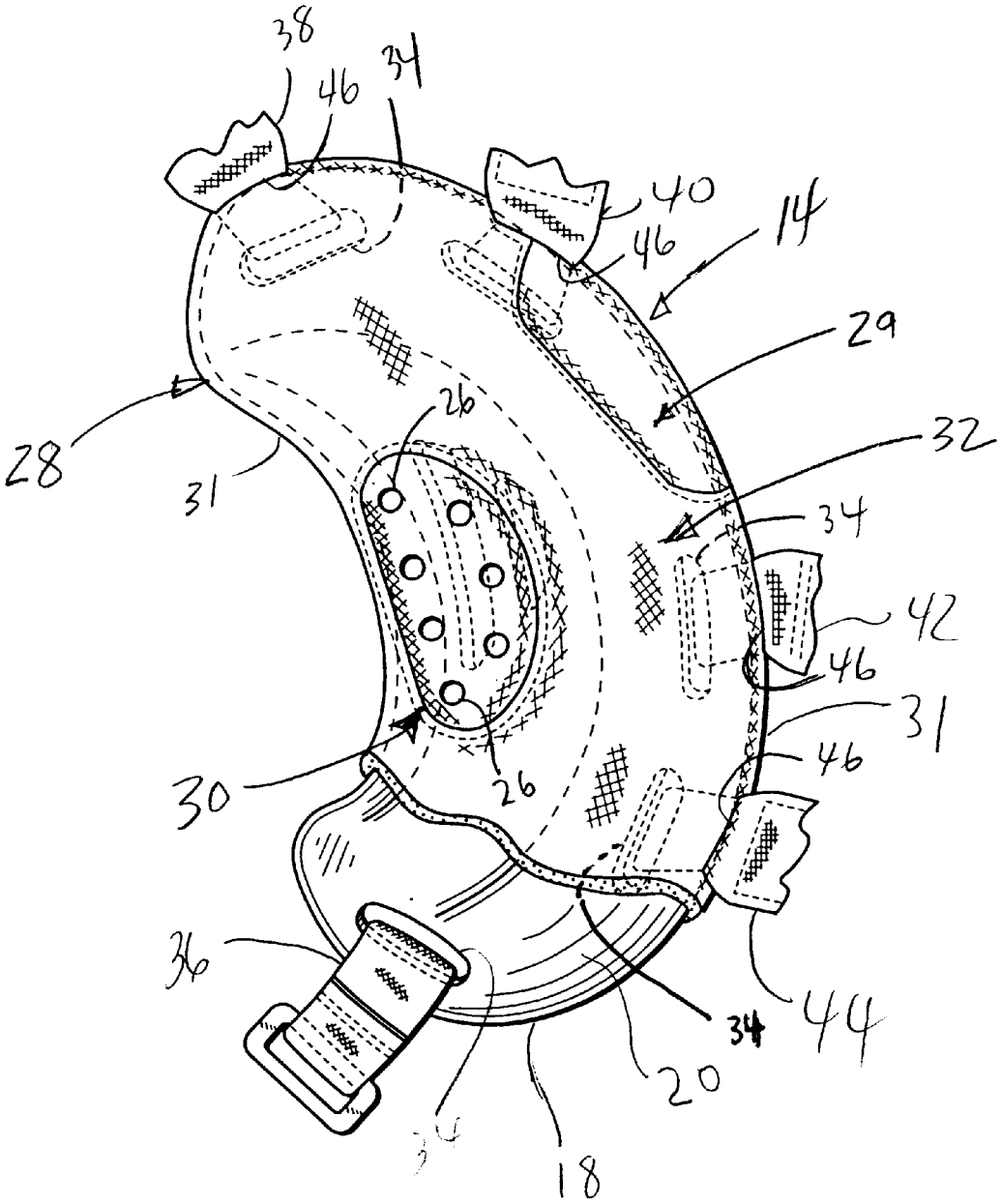
FIG. 4 is an enlarged, elevational view of the exterior of one of the protective ear guards with its straps taken along line 4—4 of FIG. 3.
Figure 6:
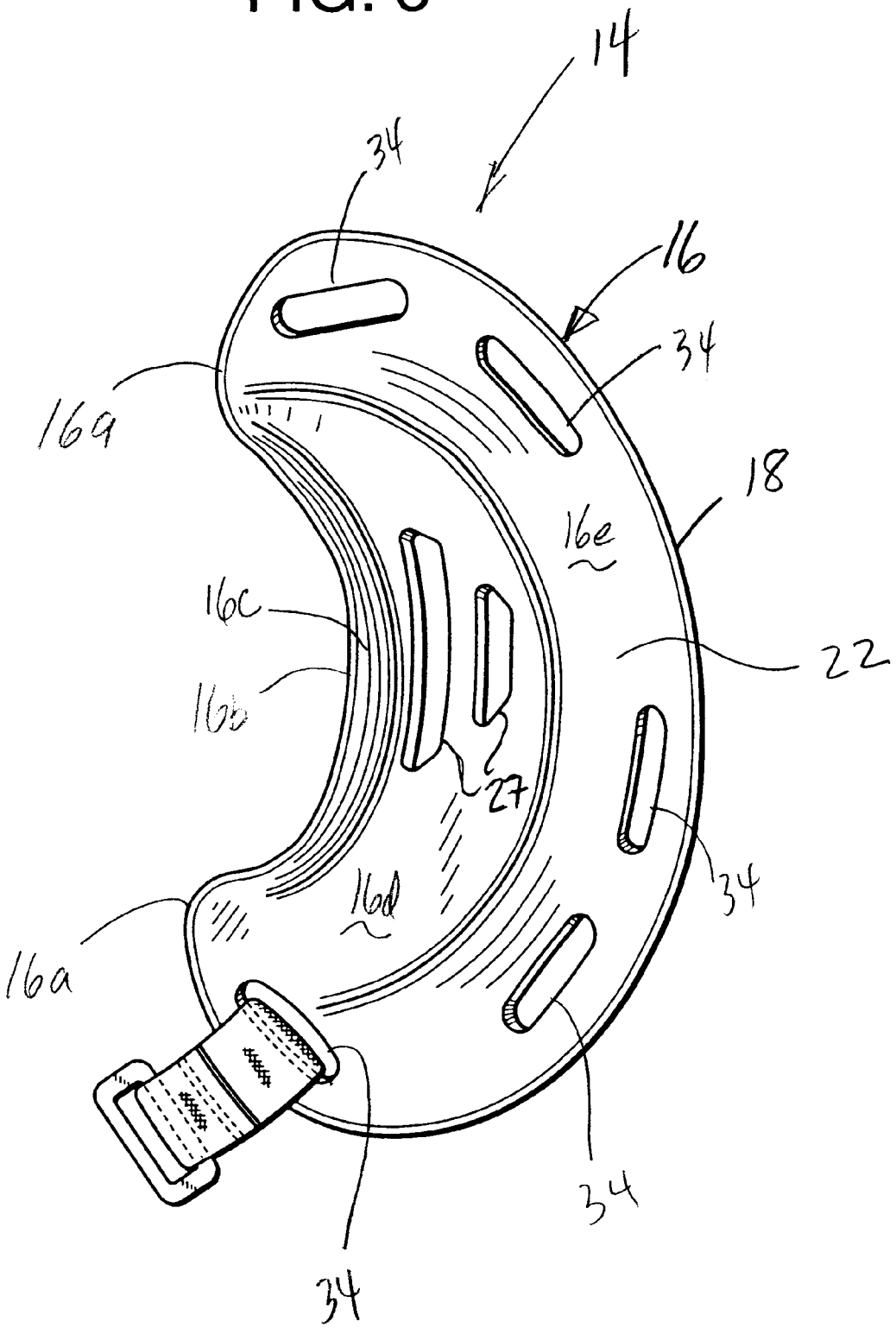
FIG. 6 is a cross-sectional view of the ear guard of FIG. 3 taken along line 6—6.

As shown in FIGS. 4 and 6, the ear guard 14 includes a generally crescent shaped or kidney shaped core 16 made of a plastic material such as molded polypropylene, which is of an arcuate configuration. The core terminates at a peripheral edge portion 18 which has a curviliner shape to define an edge of the crescent shape of core 16. The core includes an exterior surface 20 and interior surface 22. The core 16 includes forward ends 16*a,* forward edge 16*b* and a lip 16*c* along the curvilinear forward edge. The core 16 also includes a generally flat portion 16*d,* and a flange portion 16*e* that angles out from the flat portion 16*d* to the edge 18.

In use, the ear guard 12, 14 is positioned close to a user's head at a forward portion of the user's ear, and extends back the ear and away from the user's head until the edge 18 is positioned behind the user's ear and adjacent the user's head. This crescent shape of ear guards 12, 14 serves to minimize interference with a user's vision and maximize the comfort of the fit by following the contours of the user's head and ears.

A pattern of vent openings 27 is provided on the flat portion 16*d* of the core 16. The vent openings 27 connect the interior surface 22 and exterior surface 20 of ear guards 12, 14 and permit the wearer to hear while preventing damage to the ear drum due to variations in pressure caused by the movement of the ear guards 12, 14. The vent openings 27 can be sized and shaped as desired.

Figure 2:
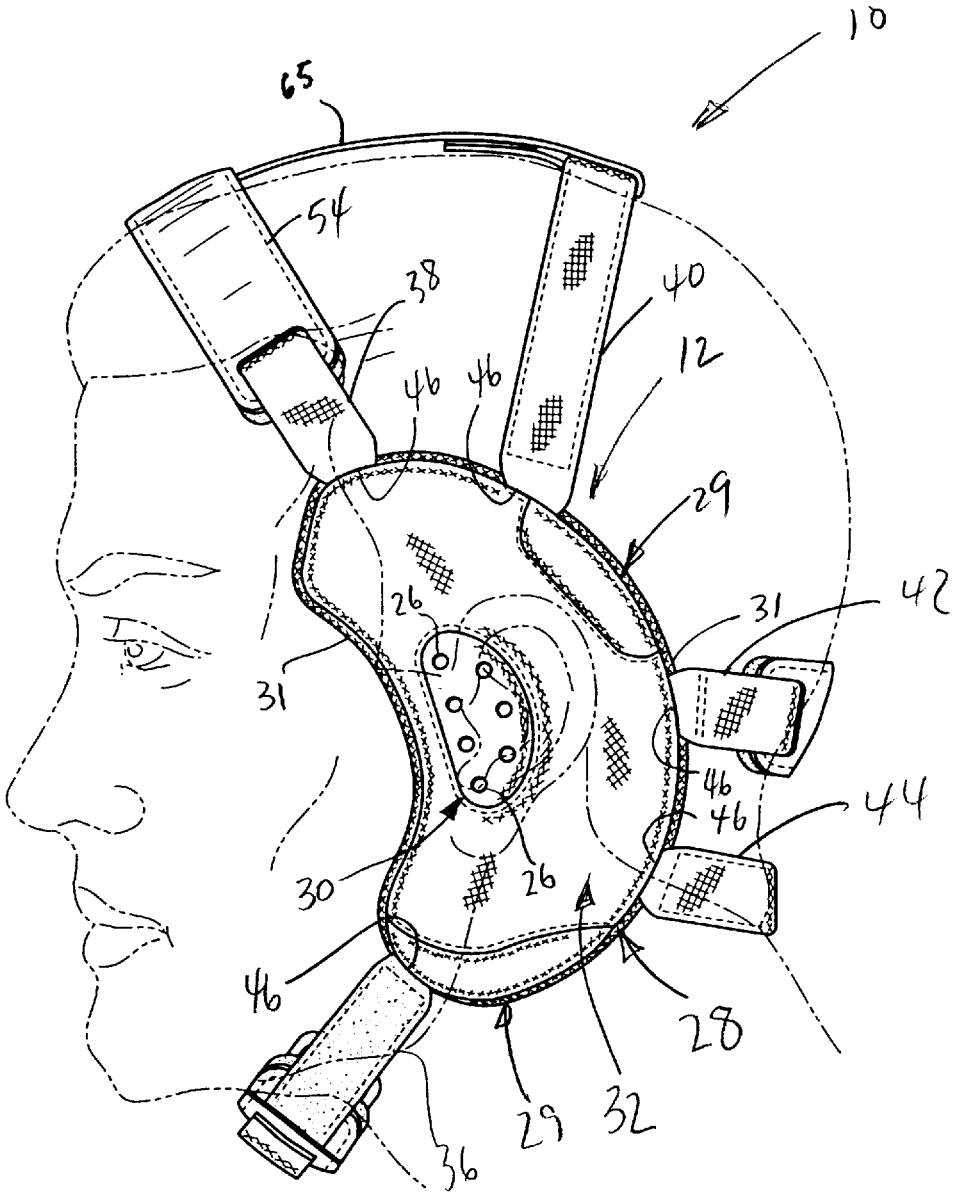
FIG. 2 is a side elevational view showing the wrestling headgear of this invention positioned on a wearer's head.

As shown in FIGS. 1, 2 and 4, a one-piece removable, flexible ear guard covering 28, preferably made of a soft polymeric material such as Neoprene, covers each ear guard 12, 14. The covering 28 has a core portion 30 that covers a central portion of the core 16. The core portion 30 includes a plurality of vent openings 26, positioned proximate to the pattern of vent openings 27, so that sound can travel through the vent openings 26 and through the pattern of vent openings 27 to allow a user to hear through the ear guards 12, 14.

The covering 28 also includes a peripheral portion 32 that covers the periphery of the exterior surface 20 of core 16 and extends between the core portion 30 and an edge 31 of covering 28. The peripheral portion 32 is interconnected with stitching or by other means known in the art with the core portion 30. Additionally, decorative portions 29 may be included in the covering 28, as desired, and interconnected with the periphery portion 32. The decorative portions 29 could match the color of the core portion 30 if desired. The entire exterior surface 20 of core 16 is thus covered by covering 28.

Figure 5:
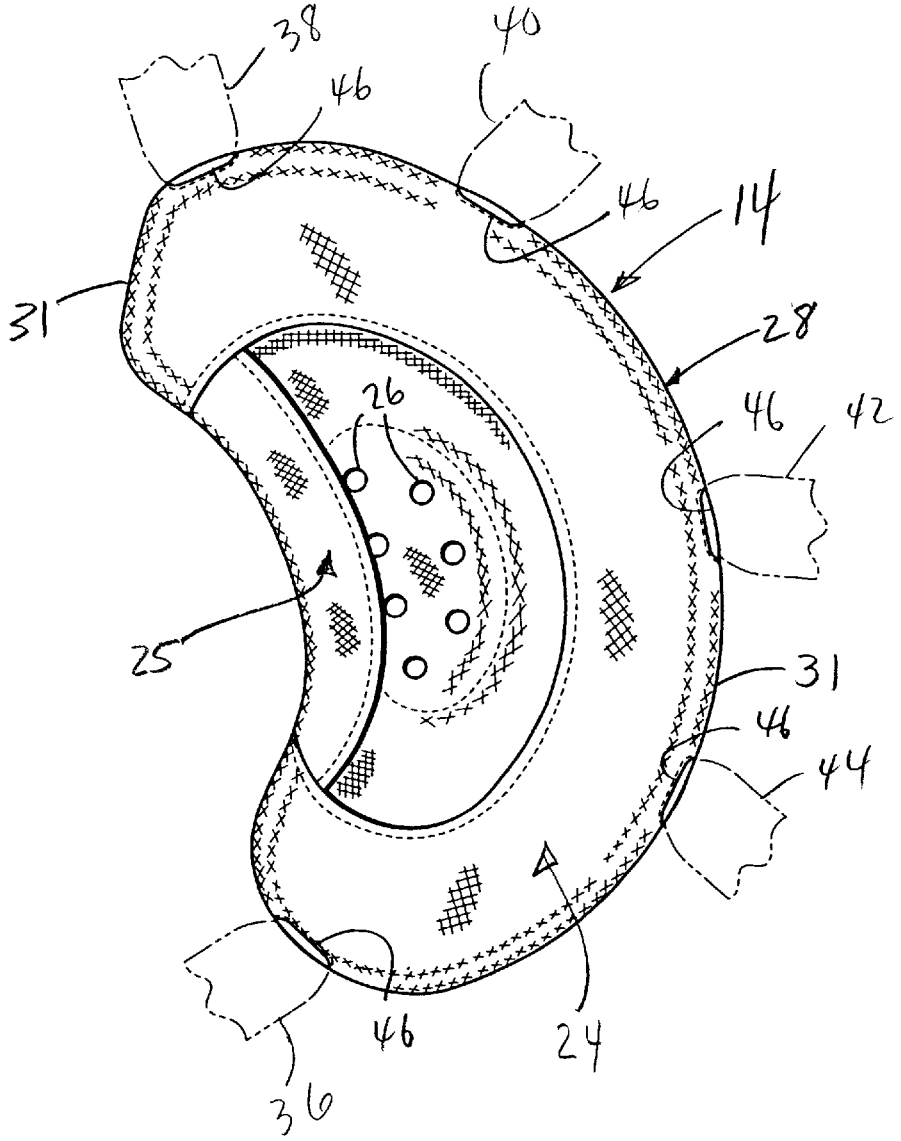
FIG. 5 is an enlarged, elevational view of the interior of one of the protective ear guards with its straps taken along line 5—5 of FIG. 3.

As shown in FIG. 5, the covering 28 also includes an interior portion 24 interconnected with the peripheral portion 32 and any decorative portion 29, along edge 31. A flap portion 25 also interconnected with the peripheral portion 32 and covers the forward edge 16*b* of the core 16. The interior portion and flap portion 24 and 25 extend about the core 16 to retain the core within the covering 28. A layer of gel cushioning material could be positioned within the interior portion 24 of the covering 28 for increased comfort to the user. The covering 28 has a relatively high coefficient of friction between the interior and flap portions 24, 25 and the skin surrounding the ear to thus provide an ear guard 12, 14 that does not slip off as easily as does known headgear. The flap portion 25 is movable to facilitate changing the covering 28 to permit replacement thereof, due to tearing, wear, etc.

Referring again to FIGS. 4 and 6, each ear guard 12, 14 has a plurality of elongate apertures 34 positioned on the flange portion 16*e* along the peripheral edge 18 of the core 16. A plurality of head straps 36, 38, 40, 42, 44 interconnect with the elongate apertures and extend about the head of a user to secure the headgear 10 to the user's head. The covering 28 is provided along its outer edge 31 with a plurality of slots 46 which permit the head straps 36, 38, 40, 42, 44 to extend therethrough and to be attached to the core 16.

Each head strap is secured at one end to one ear guard 12 and at the other end to the other ear guard 14. Also, the head straps are adjustable, preferably by means of releasable engageable hook 48*a* and pile 48*b* type retainers on the head strap. More specifically, referring to FIGS. 1–3, head straps 40, 42, and 44 are generally identical to each other. Referring to head strap 40 as illustrative of each of these straps, the strap 44 is formed of a fabric material. One end extends through one of the slots 46 of the covering 28 and the elongate aperture 34 in the core 16 and is folded upon itself and stitched to form a loop. The opposite end of head strap 44 has thereon releasable engageable hook 48*a* and pile 48*b* type retainers. This end is passed through a corresponding slot 46 and elongate aperture 34 in the other core 16 and is folded upon itself to engage the hook 48*a* and pile 48*b* type retainers to provide an adjustable, releasable engageable retainer.

Figure 3:
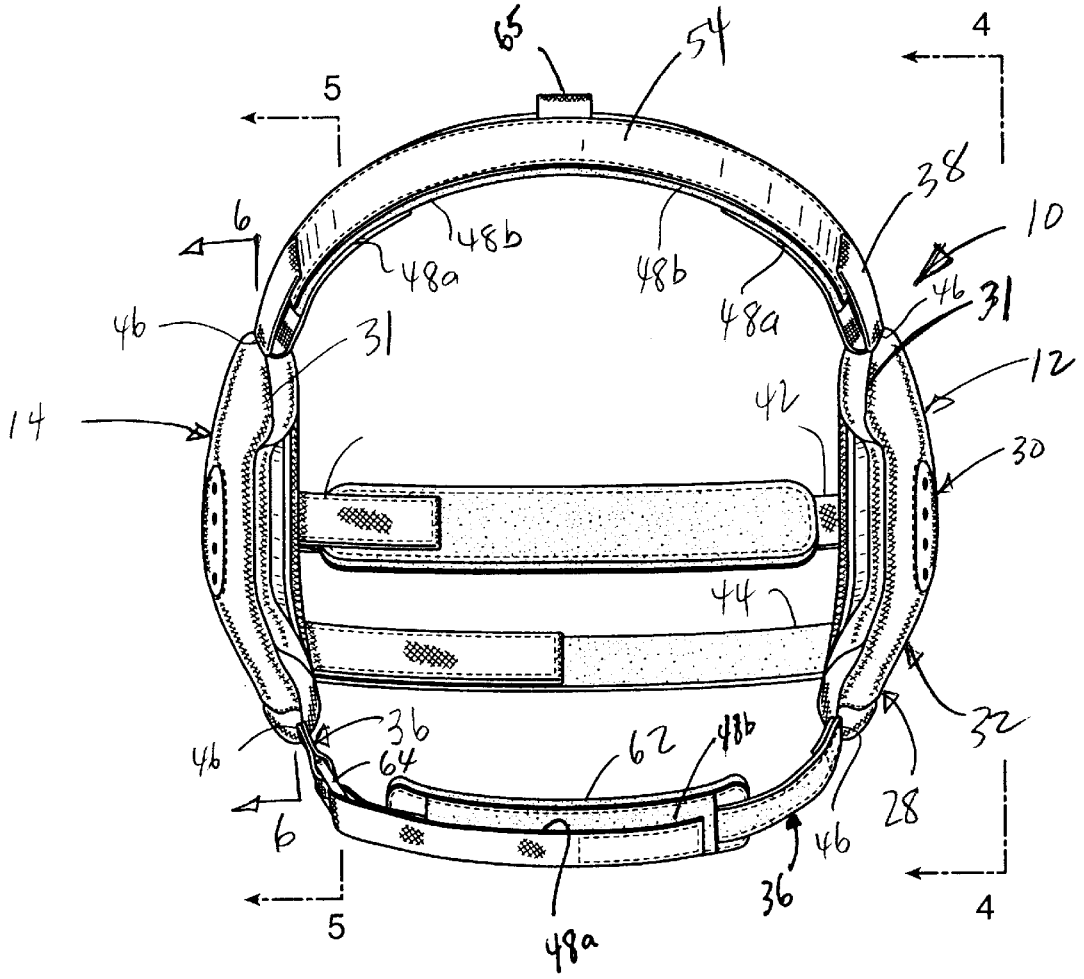
FIG. 3 is bottom elevational view of the wrestling headgear of this invention.

Referring to FIG. 3, forehead strap 38 is provided with an adjustable, releasable engageable retainer on each end of the strap 38 to permit the wider forehead center portion 54 of strap 38 to be centered on the forehead of the wrestler. More specifically, each end portion of the forehead strap 38 has thereon releasable engageable hook 48*a* and pile 48*b* type retainers. The end portions are each passed through corresponding elongate apertures 34, and folded upon themselves to provide adjustable, releasable engageable retainers on each end portion of strap 38. A retaining strap 65 can extend between forehead strap 38 and top head strap 40 maintain the relative positions of the straps.

Still referring to FIG. 3, the chin strap 36 has one end that is received in an associated one of the elongate apertures 34 of the ear guard 12, folded upon itself and stitched together. Slidably, adjustably retained on strap 36 is a chin piece 62 with pile type material 48*a* on one side thereof. Affixed to a corresponding elongate aperture 34 on the other ear guard 14 is a link 64. The opposite end portion of the chin strap 36 has thereon releasable engageable hook 48*a* type retainers. This end portion is passed through the link 64 and folded on the pile type material 48*b* on the chin piece 62 to provide an adjustable, releasable engageable chin strap 36.

Figure 7:
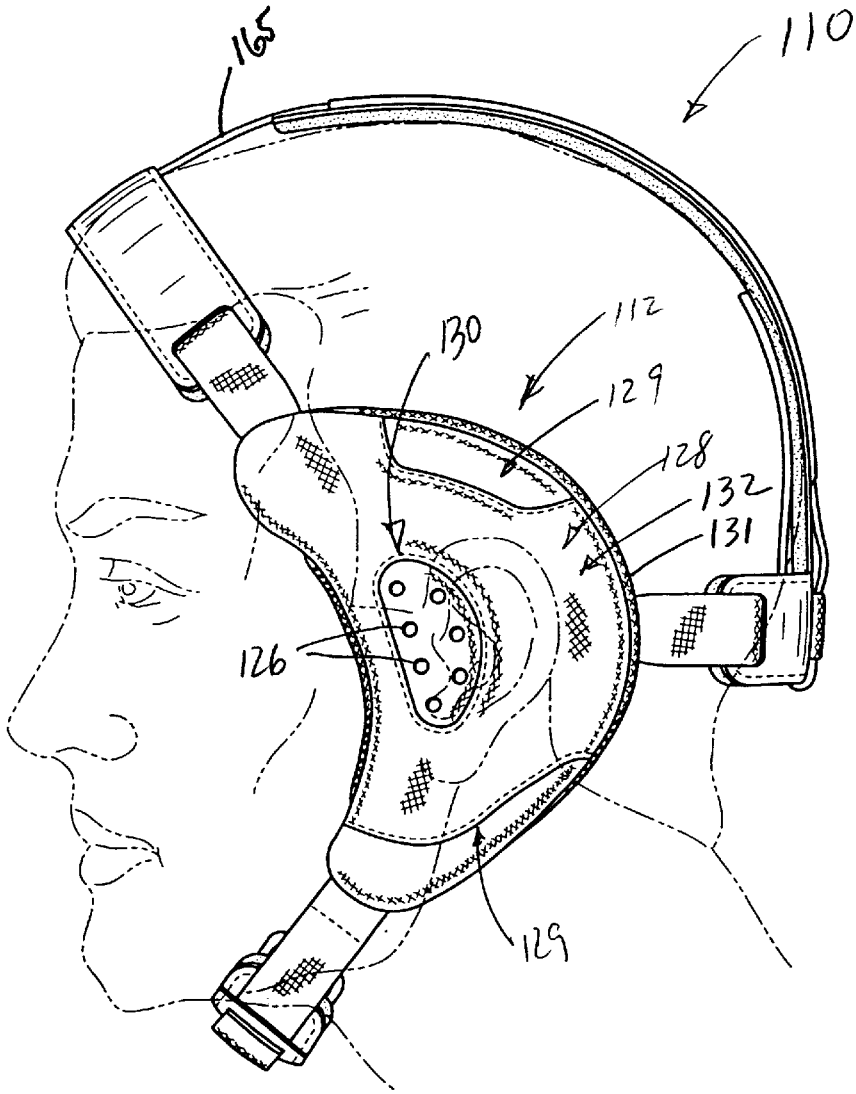
FIG. 7 is a side elevational view showing another embodiment of the wrestling headgear of this invention positioned upon a wearer's head.
Figure 8:
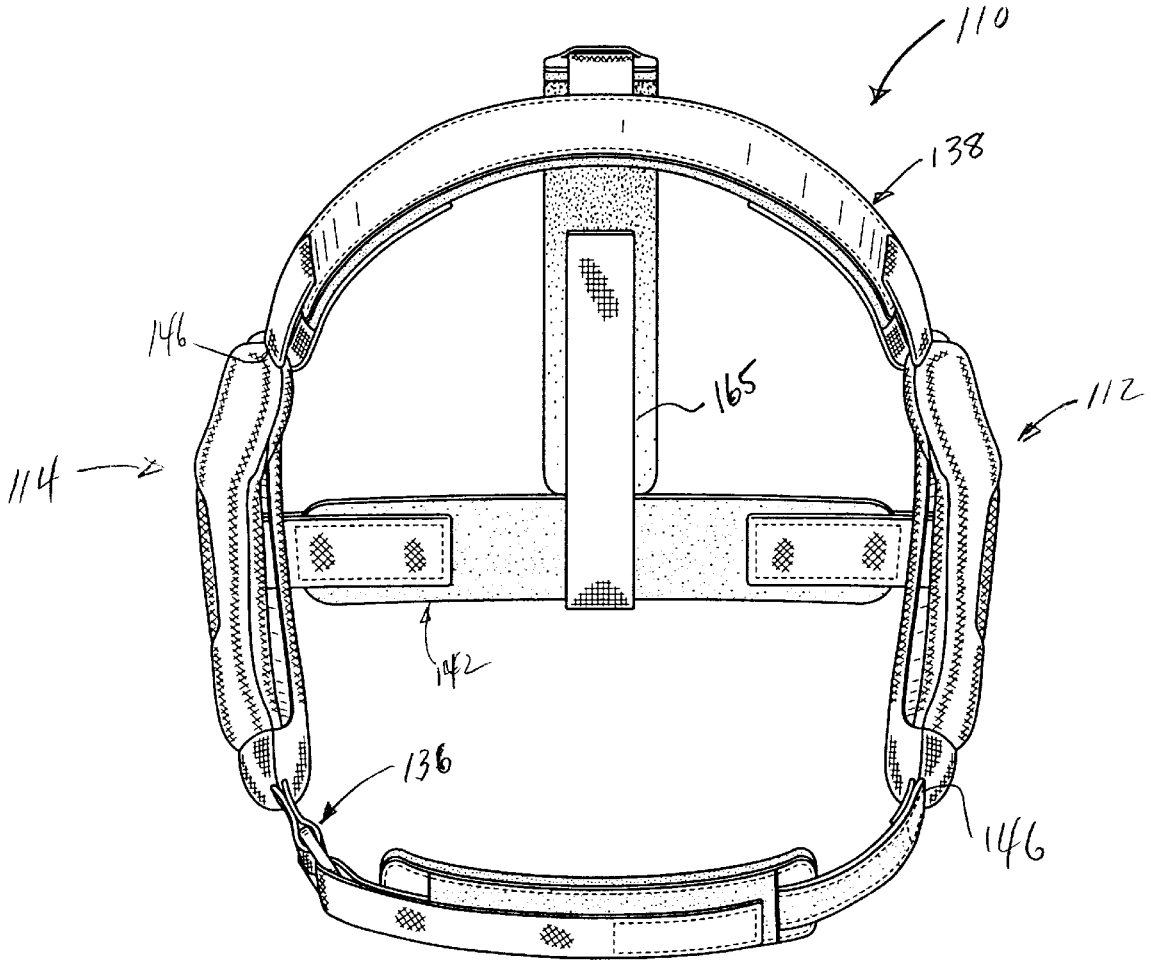
FIG. 8 is bottom elevational view of the wrestling headgear shown in FIG. 7.
Figure 9:
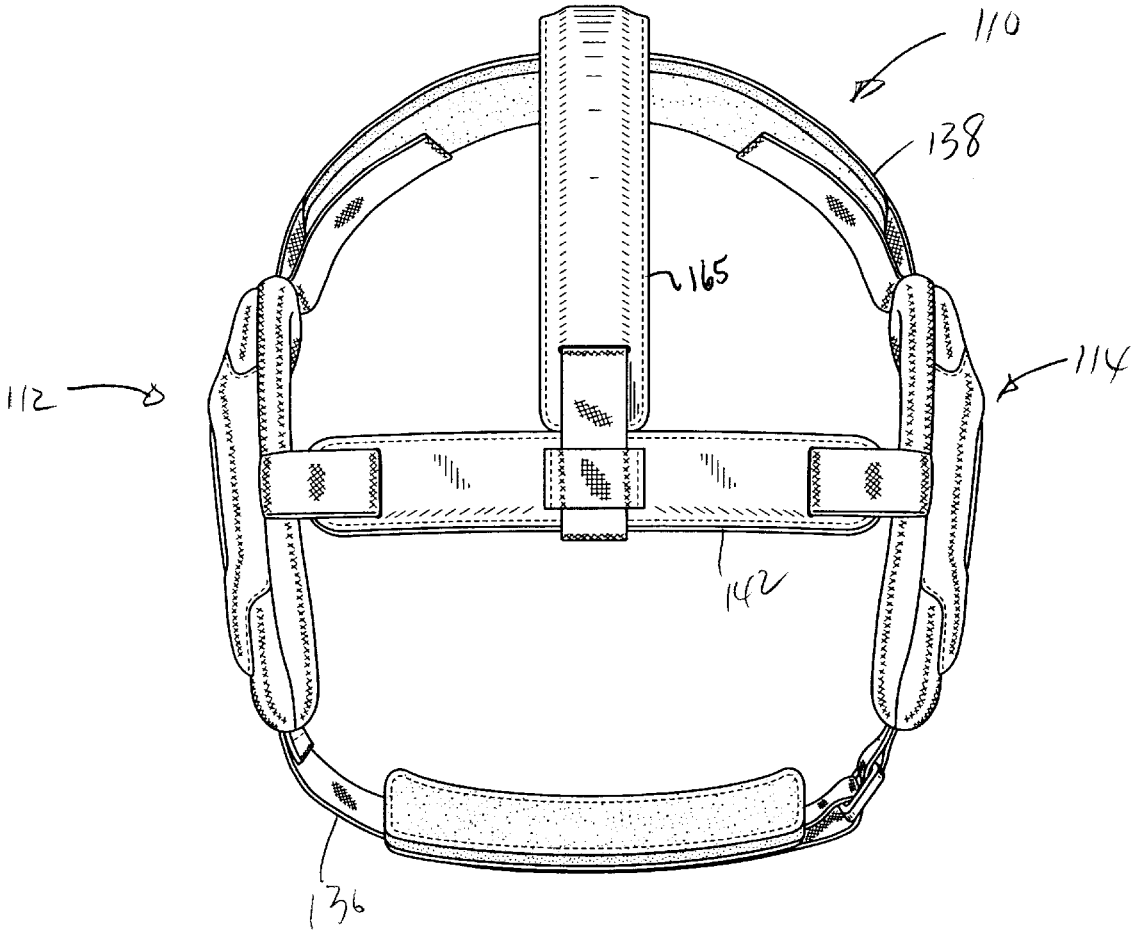
FIG. 9 is a top elevational view of the wrestling headgear shown in FIG. 7.

FIGS. 7–9 show another embodiment of the headgear of the present invention. This embodiment is of a similar construction and operates in a similar manner as the first embodiment, but utilizes three head straps as opposed to five. The headgear, generally indicated at 110 includes ear guards 112, 114 having generally crescent or kidney shapes. A one-piece removable, flexible ear guard covering 128 covers the ear guards 112, 114. The covering 128 has a core portion 130 that includes a plurality of vent openings 126 to allow a user to hear.

The covering 128 also includes a peripheral edge portion 132 extending between the core portion 130 and an edge 131. Additionally, decorative portions 129 may be included as desired. The decorative portions 129 could match the color of the core portion 130 if desired.

As shown in FIGS. 8 and 9, a plurality of head straps 136, 138, 142, interconnect with the elongate apertures and extend about the head of a user to secure the headgear 110 to the user's head. The covering 128 is provided along its outer edge 131 with a plurality of slots 146 which permit the head straps 136, 138, 142, to extend therethrough. The head straps are interconnected with the ear guards as described with respect to FIGS. 1–6. A retaining strap 165 may retain relative positioning of straps.

The headgear of this invention provides enhanced protection for a wrestler's ears from injuries through the use of a unique crescent or kidney shaped ear guard. Additionally, a cushioning element surrounding the ears provides for added comfort. The head straps allow the headgear to be securely affixed to the head with a minimum of straps that are easily adjustable and will not come out of adjustment. The head gear further has an ear guard that has an improved gripping surface surrounding the ear, is relatively comfortable and is relatively inexpensive and easy to manufacture.

While preferred forms and arrangements of parts have been shown in illustrating the invention, it is to be clearly understood that various changes in details and arrangement of parts may be made without departing from the spirit and scope of the disclosure.

What is claimed is:

1. An article of protective headgear comprising:

a pair of ear guards each of which comprises:

a generally crescent-shaped core having a curved, concave forward edge, a peripheral edge portion, an interior surface and an exterior surface;

an ear guard cover extending over the exterior surface of the core, and about a portion of the interior surface;

a plurality of elongate apertures along the peripheral edge portion of each ear guard;

a plurality of slots in the cover corresponding to the plurality of elongate apertures; and a plurality of head straps, each head strap having one end extending through one of the plurality of slots in the cover and secured to one of the elongate apertures on one ear guard, and the other end extending through one of the plurality of slots in the cover and adjustably secured to a corresponding elongate aperture on the other ear guard by releasably engageable hook and pile type fasteners on the head straps.

2. The headgear of claim 1 wherein the crescent-shaped core comprises a rigid construction.

3. The headgear of claim 2 wherein the core comprises plastic.

4. The headgear of claim 1 wherein the core includes a pattern of vent openings.

5. The headgear of claim 4 wherein the cover includes a plurality of vent openings positioned proximate the pattern of vent openings in the core.

6. The headgear of claim 1 further comprising a layer of silicon gel cushioning material positioned within the cover and along the interior surface of the core.

7. The headgear of claim 1 wherein the cover comprises soft polymeric material.

8. The headgear of claim 7 wherein the soft polymeric material comprises Neoprene.

9. The headgear of claim 1 wherein the cover comprises a central portion and peripheral portion.

10. The headgear of claim 9 wherein the central and peripheral portions are stitched together.

11. The headgear of claim 9 wherein the cover further comprises one or more decorative portions.

12. An article of protective headgear comprising:

a pair of ear guards each of which comprises:

a generally crescent-shaped core having a curved, concave forward edge, a peripheral edge portion, an interior surface and an exterior surface;

a pattern of a plurality of vent openings in the core connecting the interior and exterior surfaces;

a one-piece removable ear guard covering of soft material, the covering comprising:

a core portion with vent openings proximate to plurality of vent openings in the core;

a peripheral edge portion extending between the core portion and a peripheral edge;

a plurality of elongate apertures associated with the peripheral edge portion of each core;

a plurality of slots in the cover proximate the elongate apertures in the core; and a plurality of head straps, each head strap having one end extending through a slot and secured to an elongate aperture on one ear guard and the other end adjustably extending through a slot and secured to a corresponding elongate aperture on the other ear guard by releasable engageable hook and pile retainers on the head strap.

13. The headgear of claim 12 wherein the crescent-shaped core comprises a rigid construction.

14. The headgear of claim 13 wherein the core comprises plastic.

15. The headgear of claim 12 further comprising a layer of gel cushioning material positioned within the cover and along the interior surface of the core.

16. A protective headgear comprising:

a pair of ear guards each of which comprises:

a generally crescent-shaped rigid core having a curved, concave forward edge, a peripheral edge portion, an interior surface and an exterior surface;

a cover positioned about the core exterior surface of core and about the peripheral edge portion of the interior surface;

a plurality of elongate apertures associated with the peripheral edge portion of each core;

a plurality of slots positioned about a peripheral edge of the cover proximate the plurality of elongate aperture; and a plurality of head straps, each end thereof extending a slot in the cover and adjustably secured to a corresponding elongate aperture on each guard by releasable engageable hook and pile retainers on the head strap.

17. The headgear of claim 16 wherein the cover includes a plurality of vent openings positioned proximate the pattern of vent openings in the core.

18. The headgear of claim 16 further comprising a layer of gel cushioning material positioned within the cover and along the interior surface of the core.

19. The headgear of claim 16 further comprising a flap interconnected with the cover and positioned over the interior surface of the core and along the crescent-shaped forward edge.

20. The headgear of claim 19 wherein the flap is removable to facilitate removing the core and replacing the cover.

21. The headgear of claim 16 comprising fine headstraps.

22. The headgear of claim 16 comprising three headstraps.

23. The headgear of claim 16 wherein the core further comprises a lip positioned adjacent the forward edge.

24. The headgear of claim 23 wherein the core further comprises a generally flat portion interconnected with the lip, and a flange portion that angles out from the generally flat portion to accommodate a wearer's ear.

* * * * *

UNITED STATES PATENT AND TRADEMARK OFFICE

CERTIFICATE OF CORRECTION

PATENT NO. : 6,418,565 B1
DATED : July 16, 2002
INVENTOR(S) : Kanzo Tsujino

It is certified that error appears in the above-identified patent and that said Letters Patent is hereby corrected as shown below:

Title page,
Item [73], Assignee, delete "ASKS Corporation" and insert -- ASICS Corporation --.

Signed and Sealed this

Fourth Day of April, 2006

JON W. DUDAS
*Director of the United States Patent and Trademark Office*